United States Patent [19]

Gagas

[11] Patent Number: 4,927,163

[45] Date of Patent: May 22, 1990

[54] STORM INFILTERATION DISK WITH FILTER

[76] Inventor: Stanley Gagas, 3642 E. American Ave., Oak Creek, Wis. 53154

[21] Appl. No.: 288,464

[22] Filed: Dec. 22, 1988

[51] Int. Cl.[5] ..... F16J 15/10; E02D 29/14

[52] U.S. Cl. ..... 277/23; 52/20; 210/170; 277/182; 277/184; 404/25

[58] Field of Search ..... 277/23, 101, 180, 182, 277/184; 404/24, 25, 26; 52/20, 21; 210/153, 154, 155, 156, 162, 170

[56] References Cited

U.S. PATENT DOCUMENTS 4,368,893 1/1983 Gagas ..... 404/25

4,419,232 12/1983 Arntyr et al. ..... 210/170

4,540,310 9/1985 Ditcher et al. ..... 404/25

*Primary Examiner*—Allan N. Shoap

*Assistant Examiner*—Scott Cummings

*Attorney, Agent, or Firm*—Foley & Lardner

[57] ABSTRACT

An infiltration system for a manhole and manhole cover assembly, the system including an infiltration disk positioned between the manhole and cover assembly, the disk including a flange encircling the manhole and cover assembly and a filtration means in the gap between the flange and cover assembly to prevent ingress of solid matter into the space between the manhole cover and the disk.

5 Claims, 1 Drawing Sheet

STORM INFILTERATION DISK WITH FILTER

BACKGROUND OF THE INVENTION

1. Field of the Invention

The present invention relates to a manhole infiltration disk and filter assembly for locating and sealing a manhold cover assembly on the top of a manhole.

2. Description of the Prior Art

In my U.S. Pat. No. 4,368,893,issued on Jan. 18, 1983 and entitled Manhole Infiltration Disk and Seal Assembly, I disclosed and described a system for locating a manhole cover assembly on a manhole and for sealing the gap between the manhole and the manhole cover assembly. In the six or seven years of experience with this system, it has been noted that as the seal material hardens, sufficient water will infiltrate the gap causing upheavals as a result of the freezing and melting of the water. These upheavals allow foreign matter such as sand, soil and stones to accumulate in the gap between the disk and the manhole cover assembly which eventually creates an opening that will allow water to flow into the manhole. This problem was further compounded by the inclusion of a flange on the periphery of the inside diameter of the ring which created a trough with the accumulation of water, sand and soil, and increased the upheaval in the manhole cover assembly.

In storm manholes, catch basins and curb catch basins, the manhole cover assembly is installed with mortar on the top of the manhole cover assembly. After a short time the mortar starts to deteriorate and then sand, stone and ground start to leak into the manholes or catch basins. The overlying cement or black top then starts to break, crack and settle around the manhole cover assembly. Concrete and black top do not adhere to the manhole cover assembly, it always pulls away. This allows water to wash away the underlying sand, stones and ground which accumulate under the manhole cover assembly causing upheavels of the manhole cover assembly.

SUMMARY OF THE PRESENT INVENTION

The present invention minimizes the upheaval problem by initially eliminating the flange on the inside periphery of the infiltration disk and providing a filtration system which allows only water to flow between the manhole cover assembly and the infiltration disk. The gap between the manhole and the infiltration disk is also provided with a flexible sealant which does not harden and retains its elasticity under all kinds of weather conditions.

A principal feature of the invention is the provision of an infiltration disk which minimizes the accumulation of water in the gap between the manhole cover assembly and the infiltration disk.

A further advantage of the invention is the inclusion of a filtering pad in the gap between the manhole cover assembly and the infiltration disk to prevent the ingress of foreign matter other than water into the gap between the infiltration disk and manhole cover assembly.

A further feature of the invention is the provision of a filtering medium between the manhole cover assembly and the infiltration disk which prevents the ingress of foreign matter other than water into the gap between the manhole cover assembly and the disk.

Other principal features and advantages of the invention will become apparent to those skilled in the art upon review of the following detailed description, claims and drawings.

DETAILED DESCRIPTION OF THE DRAWINGS

Figure 1:
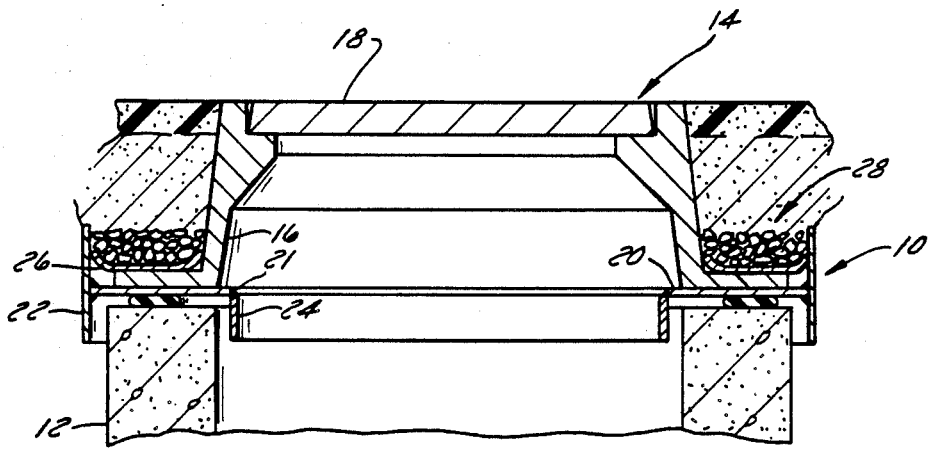
FIG. 1 is a side elevation view in cross section showing the infiltration disk, filtering medium and seal located in the gap between the manhole cover assembly and the manhole.
Figure 2:
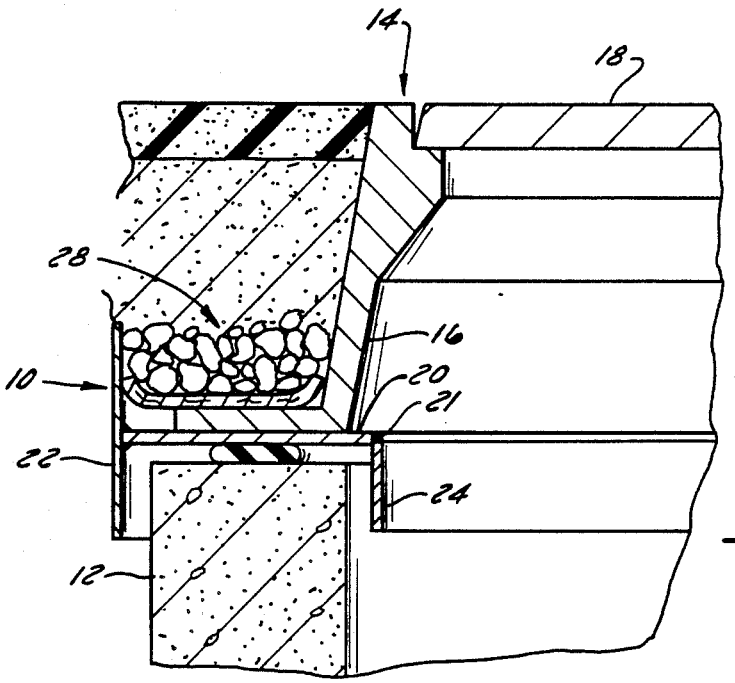
FIG. 2 is an enlarged view of the filter medium.

Before describing one embodiment of the invention in detail, it is to be understood that the invention is not limited in its application to the details of construction, and the arrangements of the components set forth in the following description and illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EXEMPLARY EMBODIMENT

The infiltration disk 10 as seen in the drawings is positioned in the space between the top of a manhole 12 and the bottom of a manhole assembly 14 which includes a manhole frame 16 and a cover 18. The infiltration disk generally includes a plate or ring 20 having a flange 22 welded to the outer periphery of the plate 20. The plate is provided with a central opening 21. The disk 10 is centered on the manhole by means of a flange 24 welded around the perimeter of the opening 21.

It should be noted that the outer flange 22 extends both upwardly and downwardly from the plate 20 while the inner peripheral flange 24 depends only from the plate 20. With this arrangement water accumulation on the plate 20 is free to flow into the manhole 12. The disk can be formed of any of a number of weather-resistant materials and can be coated with a rust protection material such as Ziebart to increase the life of the disk, if desired.

Means are provided for sealing the gap between the infiltration disk and the manhole to prevent the accumulation of water in the space between the disk and the manhole. Such means is in the form of a butyl based joint sealing compounded of 100 percent solids and containing vulcanized butyl rubber. This type of a sealant will retain its resiliency for many years. It is available under the name Kent-Seal No. 2 from Hamilton-Kent of Ohio, a division of BTR, Inc. When used with concrete, Kent-Seal No. 2 adhesive should be used to bond the butyl rubber joint sealant to the manhole.

The ingress of foreign matter into the gap between the manhole cover frame and the infiltration disk is prevented by means of a filter pad 26. The pad 26 is formed from a non-woven fibrous material distributed under the tradename SUPAC N by Phillips Fiber Corporation of Greenville, S.C. As shown in FIG. 1, the pad 26 is placed on the foot of the manhole cover frame 16 in abutting arrangement with the flange 22 on the plate 20. The pad 26 is retained in position on the disk by means of coarse aggregate 28 placed on the pad prior to back-filling the opening around the manhole frame.

Thus, it is apparent that there has been provided, in accordance with the invention, a infiltration disk system that fully satisfies the aims and advantages set forth above. While the invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An infiltration system for sealing the gap between a manhole and a manhole cover assembly, said system comprising:

an infiltration disk positioned between the manhole and the manhole cover assembly, said disk including a circular plate having a flange on the outer periphery thereof extending above and below said plate, said flange encircling the outer perimeter of the manhold and being spaced radially outwardly from said manhole cover assembly, and a filtration means positioned in said radial space between said flange and said cover assembly for preventing ingress of solid matter into said radial space between said manhole cover assembly and said flange.

2. The system according to claim 1, including means for sealing said plate to the top of the manhole to prevent the flow of water through the gap between the disk and the manhole.

3. The system according to claim 2, wherein said seal means comprises a butyl rubber strip having the characteristics of long resilient life.

4. The system according to claim 3 wherein said plate includes a center opening and a flange depending from the edge of said opening for centering said plate on said manhole.

5. The system according to claim 1, 2, 3, or 4 wherein said filtration means comprises a non-woven fiber-like material.

* * * * *